US005596929A

United States Patent [19]

Fricke et al.

[11] Patent Number: 5,596,929

[45] Date of Patent: Jan. 28, 1997

[54] DEVICE FOR REGISTER CORRECTION AND FOR COMPENSATING FOR DISTORTED SHEETS IN A FEEDER OF A SHEET-FED ROTARY PRINTING PRESS

[75] Inventors: Andreas Fricke, Eberbach; Heiner Luxem, Wilhelmsfeld, both of Germany

[73] Assignee: Heidelberger Druckmaschinen AG, Heidelberg, Germany

[21] Appl. No.: 535,710

[22] Filed: Sep. 28, 1995

[30] Foreign Application Priority Data

Sep. 28, 1994 [DE] Germany ..... 44 34 624.7

[51] Int. Cl.[6] ..... B41F 21/00

[52] U.S. Cl. ..... 101/410; 101/232

[58] Field of Search ..... 101/408, 409, 101/410, 411, 232, 246; 271/253, 254, 255, 268, 82, 277, 278

[56] References Cited

U.S. PATENT DOCUMENTS

| | | | |
|---|---|---|---|
| 4,466,350 | 8/1984 | Schilling et al. | 101/410 |
| 4,664,032 | 5/1987 | Abendroth et al. | 101/411 |
| 4,858,910 | 8/1989 | Rebel et al. | 271/277 |
| 5,176,079 | 1/1993 | Pollich | 101/232 |
| 5,343,806 | 9/1994 | Fricke et al. | 101/408 |
| 5,440,983 | 8/1995 | Döpke et al. | 101/410 |

FOREIGN PATENT DOCUMENTS 8816641 3/1990 Germany .

*Primary Examiner*—Christopher A. Bennett
*Attorney, Agent, or Firm*—Herbert L. Lerner; Laurence A. Greenberg

[57] ABSTRACT

Device for register correction and for compensating for distorted sheets in a pregripper of a feeder for a sheet-fed rotary printing press has a frame-fixed brace disposed on a pregripper shaft and located approximately centrally between end supports on a gripper bar, the gripper bar being supported rigid against torsion at opposite ends thereof on the pregripper shaft and being capable of executing swivelling movements in a sheet-feeding direction and in a direction opposite thereto, the frame-fixed brace serving for elastically bending the gripper bar in the sheet-feeding direction before the sheet is gripped by sheet grippers which are disposed side by side on the gripper bar and are swivellable about an axis of the pregripper shaft, the brace including a cam roller by which it runs onto an adjustable cam having a frame-fixed support, and an articulated joint with an eccentric element having a lever arm connected thereto for carrying the cam roller spaced from a center of the eccentric element.

7 Claims, 2 Drawing Sheets

DEVICE FOR REGISTER CORRECTION AND FOR COMPENSATING FOR DISTORTED SHEETS IN A FEEDER OF A SHEET-FED ROTARY PRINTING PRESS

BACKGROUND OF THE INVENTION

1. Field of the Invention

The invention relates to a device for register correction and for compensating for distorted sheets in a feeder, more particularly, a pregripper in the feeder, of a sheet-fed rotary printing press, having a frame-fixed brace disposed on a pregripper shaft and located approximately centrally between end supports on a gripper bar, the gripper bar being supported rigid against torsion at opposite ends thereof on the pregripper shaft and being capable of executing swivelling movements in a sheet-feeding direction and in a direction opposite thereto, the frame-fixed brace serving for elastically bending the gripper bar in the sheet-feeding direction before the sheet is gripped by sheet grippers which are disposed side by side on the gripper bar and are swivellable about an axis of the pregripper shaft.

The foregoing state of the prior art is exemplified in the published German Patent Document DE 88 16 641 U1. FIG. 3 of this reference shows an embodiment wherein a cam roller is supported on a three-point lever which, in turn, is swivellably mounted on a support arm which is disposed approximately centrally between two end supports of a gripper bar and is also joined firmly to the gripper bar, on the one hand, and is braced against the support arm between the pivot bearing and the gripper bar, on the other hand. The cam is located on a ring surrounding the pregripper shaft and is adjustable in the angular position thereof by an adjusting member so that, during the swivelling motion of the pregripper prior to reaching the end position thereof wherein the sheet grippers engage the sheet at the leading edge thereof, the cam roller runs up onto the cam earlier or later and more or less, depending upon the adjustment of the cam, and the gripper bar bends at the middle thereof in the sheet feeding direction. The sheet is thereby deformed in the middle with respect to the ends thereof, in order to effect a register correction or tension equalization. In the heretofore known arrangement of this reference, the deflection of the cam roller is less than the desired bending of the gripper bar, so that the force originating from the cam and the cam roller must be greater than the force required to deform the gripper bar. This increases the sensitivity or vulnerability of the system to dynamic factors and requires a very sensitive adjusting mechanism.

SUMMARY OF THE INVENTION

It is accordingly an object of the invention to provide a device for register correction and for compensating for distorted sheets in a feeder of a sheet-fed rotary printing press, having the foregoing general features yet being greatly improved with respect to the sensitivity or vulnerability thereof to dynamic factors, and being constructed so as to be adjustable in a relatively simple manner while the press is in operation.

With the foregoing and other objects in view, there is provided, in accordance with the invention, a device for register correction and for compensating for distorted sheets in a pregripper of a feeder for a sheet-fed rotary printing press, having a frame-fixed brace disposed on a pregripper shaft and located approximately centrally between end supports on a gripper bar, the gripper bar being supported rigid against torsion at opposite ends thereof on the pregripper shaft and being capable of executing swivelling movements in a sheet-feeding direction and in a direction opposite thereto, the frame-fixed brace serving for elastically bending the gripper bar in the sheet-feeding direction before the sheet is gripped by sheet grippers which are disposed side by side on the gripper bar and are swivellable about an axis of the pregripper shaft, the brace comprising a cam roller by which it runs onto an adjustable cam having a frame-fixed support, and an articulated joint with an eccentric element having a lever arm connected thereto for carrying the cam roller spaced from a center of the eccentric element.

In accordance with another feature of the invention, the eccentric element has an axis disposed approximately centrally in an imaginary plane through the axis of the pregripper shaft and a center of the gripper bar.

In accordance with a further feature of the invention, the cam and the cam roller are in cooperative engagement for rotating the eccentric element of an adjustable stop position counter to the action of a spring.

In accordance with an added feature of the invention, the cam is mounted on a frame of the printing press so as to be swivellable about an axis oriented parallel to the axis of the eccentric element, and an adjusting member is included for adjusting the cam in the swivelled position thereof.

In accordance with an additional feature of the invention, the adjusting member comprises a setscrew screwable into a thread formed in a frame-fixed nut and operative at one end thereof on the cam, and a spring for holding the cam against the one end of the setscrew.

In accordance with yet another feature of the invention, the device includes a support arm having a bearing braced on the pregripper shaft, the eccentric element being supported just below the gripper bar in the bearing of the support arm.

In accordance with a concomitant feature of the invention, the axis of the eccentric element is disposed offset towards the cam with respect to the imaginary plane through the axis of the pregripper shaft and the center of the gripper bar.

In contrast with the constructions of the prior art, the embodiment of the invention herein has the advantage that a comparatively great deflection of the cam roller, which is secured by a lever arm to the eccentric element, causes a relatively small deformation of the carrier of the gripper bar and hence of the gripper bar itself. Due to this transmission or conversion of forces, the shear force necessary for deforming the gripper bar can be reduced. In the arrangement of the invention, the requisite roller force relative to the shearing or transverse force is considerably less than in the heretofore known arrangement of the prior art. The force operative in the roller is introduced directly into the printing-press frame via the cam body. In the embodiment of the invention, it can be assumed that, because of the reduced frame force, smaller deformations of kinetostatic and dynamic origin will occur. The dynamic effects of the gripper bar on the mechanism for register correction and for tension compensation or equalization, respectively, in the sheet are expediently intercepted additionally by the action of a spring, which reliably ensures the maintenance of the original position of the gripper bar in the undeformed state, the force of the spring being reinforced by the mechanism. A higher quality of register correction is thereby achieved. Advantageously, the cam is mounted on the frame of the press so as to be swivellable about an axis oriented parallel to the axis of the eccentric element, and is held adjustably in the swivelled position thereof by an adjusting member which is variable in the adjustment thereof while the press is running, so as to permit the performance of a regulation or control of the cam position.

Other features which are considered as characteristic for the invention are set forth in the appended claims.

Although the invention is illustrated and described herein as embodied in a device for register correction and for compensating for distorted sheets in a feeder of a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
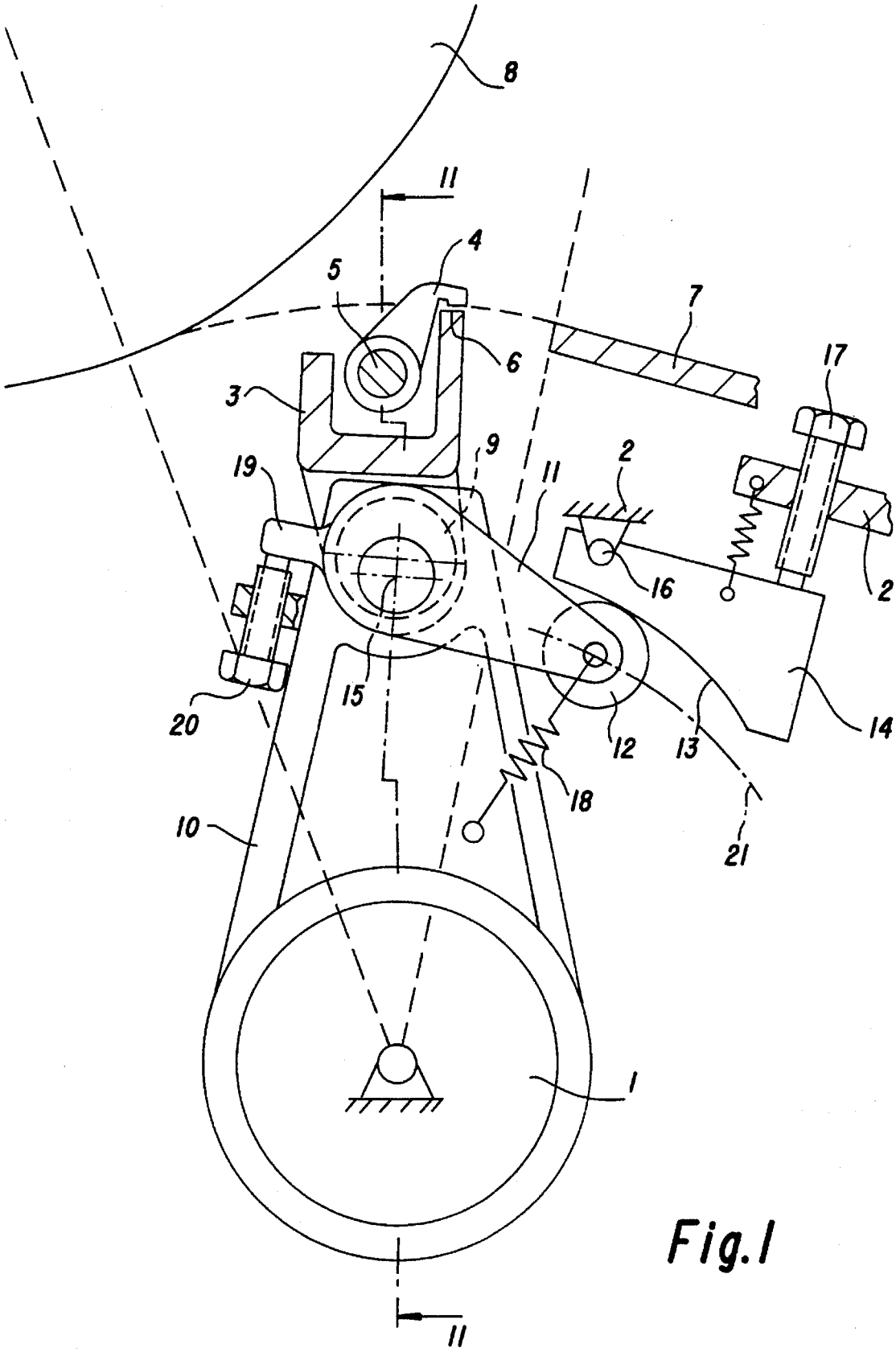
FIG. 1 is a side elevational view of the device for register correction and for compensating for distorted sheets in accordance with the invention, and showing a gripper bar in cross section.
Figure 2:
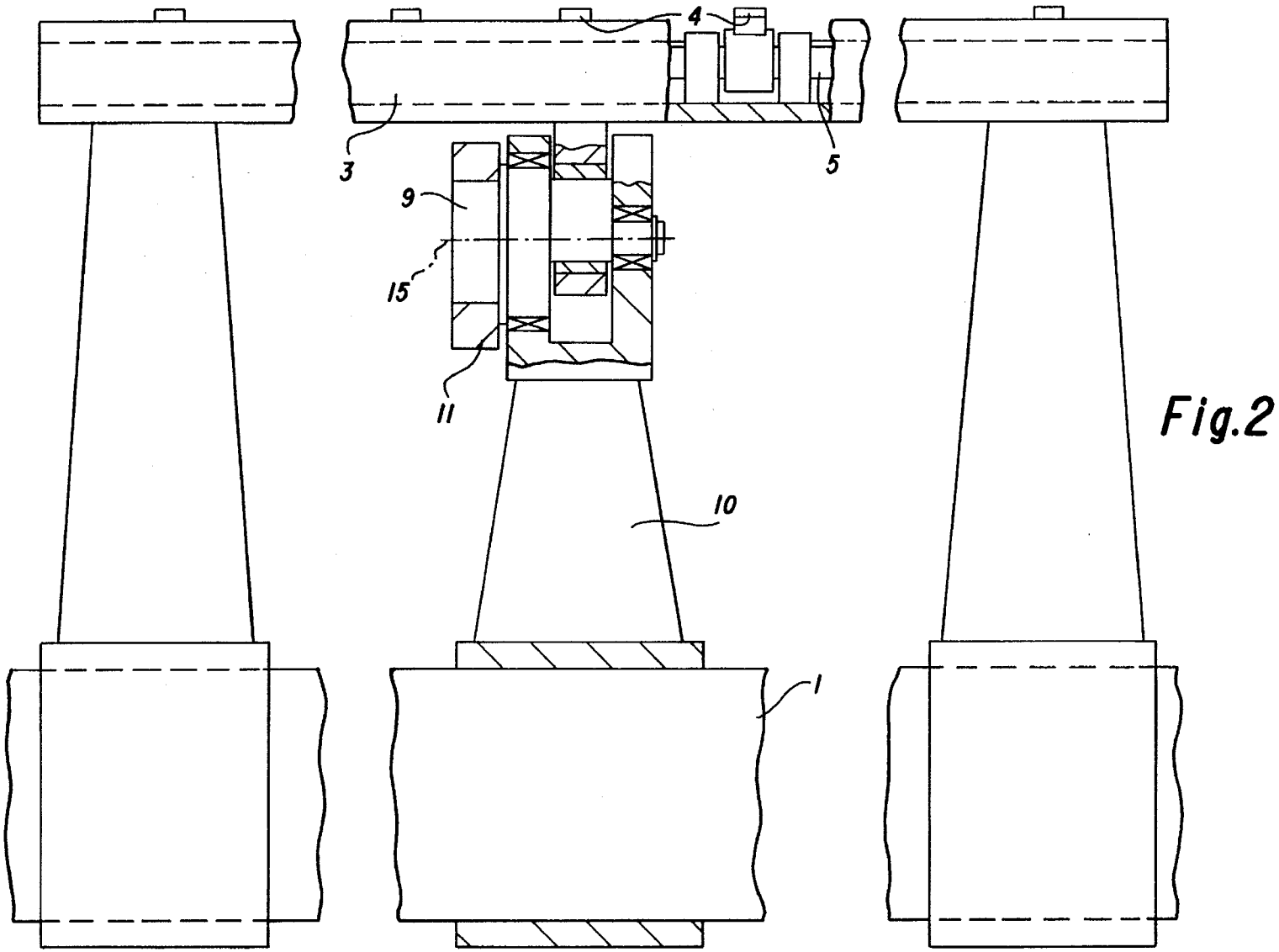
FIG. 2 is a front elevational view of FIG. 1, taken partly in section along the line II—II in FIG. 1.

Referring now to the figures of the drawing, there is shown therein a pregripper shaft 1 supported by the two ends thereof in a printing-press frame 2 so as to be swivellable reciprocatingly in a direction of sheet feeding from the right-hand side to the left-hand side of FIG. 1. The gripper bar 3 is braced rigidly against torsion by the ends thereof on the pregripper shaft 1 in a non-illustrated conventional manner. Swivellable sheet grippers 4 are mounted on a gripper shaft 5 at the gripper bar 3, in a spaced-apart side-by-side distribution across the width or breadth of the sheet, and cooperate with a gripper pad 6 on the gripper bar 3, and grip the sheet to be transported on the feeding table 7 by the leading edge of the sheet, clamping the sheet it between themselves, i.e., the grippers 4, and the gripper pad 6. With a swivelling motion of the pregripper in the direction of sheet feeding, the sheet is fed from the feeding table 7 and, at the end of the swivelling motion, is transferred to the gripper system of a feed cylinder 8.

Somewhat centrally between the two end supports or braces of the gripper bar 3 which, if necessary or desirable, is reinforced by a beam or carrier, an eccentric element 9 is mounted in a bearing under the gripper bar 3, and has another bearing by which it is braced or mounted in a support arm 10 formed on the pregripper shaft 1. A cam roller 12 is freely rotatably mounted on an arm 11 which is firmly connected to the eccentric element 9, the circumference of the cam roller 12 engaging with a cam 13 of a cam body 14, which is mounted on the frame 2 so as to be swivellable about an axis 16 oriented parallel to the bearing axis 15 of the eccentric element 9, the cam 13 being adjustable in the swivelled position thereof by a setscrew 17. A compression spring 18 urges and loads the cam roller 12 in a direction towards the cam 13 and thus urges the cam body 14 towards and against the setscrew 17. The set screw 17, which is screwed into a thread firmly secured to the press frame 2 is adjustable while the printing press is running. Outside the region whereat the cam roller 12 engages the cam 13, a stop 19 comes to a stop position against a set screw 20, which is likewise screwable into a thread secured to the housing.

After a sheet is fed from the feeding table 7 to the feed cylinder 8, the pregripper runs through a reversal or turning location and then moves back towards the feeding table 7. Shortly before the pregripper reaches the feeding table 7, the cam roller 12 runs up onto the cam 13 of the cam body 14. The cam flank is not equidistant from the path 21 of the center of the cam roller 12, so that the cam roller 12 is steadily deflected, counter to the action of the spring 18, out of the stop position effected by the spring 18 and adjustable by means of the setscrew 20. In the thus-effected rotation of the eccentric element 9 about the bearing axis 15 thereof, the gripper bar 15 is displaced substantially tangentially to the curved path of the bearing axis 15, and is deformed in the process. Due to this deformation, the gripper shaft 5 bends as well, so that the sheet grippers 4 disposed on the gripper shaft 5 are also displaced. The bearing of the eccentric element 9 in the gripper bar 3 and in a bar carrier connected thereto, respectively, is kinematically equivalent to a swivel joint, so that no torsional moment, but only a shear force, is transmitted. In an advantageous construction of this bearing, the shear force is carried through the so-called thrust center of the gripper bar profile, so that the desired central bending of the gripper bar occurs crosswise to the sheet travel direction, and no bar torsion ensues. Once the pregripper has reached the end position thereof on the feeding table 7, the maximum bending of the gripper bar 3 has occurred. This bending can be regulated within the required limits by the setscrew 17. The sheet is then gripped at the leading edge thereof by the sheet grippers 4, in the deformed position of the gripper bar and the gripper shaft 5. As the pregripper swivels away from the feeding table 7, the cam roller 12 leaves the cam 13, so that the gripper bar 3 relaxes and deforms back to its original position. Upon the transfer of the sheet to the feed cylinder 8, the sheet continues to be deformed, because the gripper bar 3 remains in the undeformed state fixed by the contact of the stop 17 with the setscrew 20. In an advantageous embodiment of the characteristics of the invention in the interest of balancing the shear forces in the sense presented hereinabove, the bearing axis 15 of the eccentric element 9 is located somewhat in an imaginary plane through the axis of the pregripper shaft and through the center of the gripper bar 3, or is slightly offset to the side from this plane, as shown in the drawing. The bearing of the eccentric element 9 and the bracing thereof in the support arm 10 are accomplished in the exemplary embodiment just below the gripper bar 3. The lateral offset of the bearing axis 15 relative to the imaginary plane through the center of the pregripper shaft 1 and through the center of the gripper shaft 5 prevents moments of torsion from becoming effective upon the gripper bar 3.

We claim:

1. A device for register correction and for compensating for distorted sheets in a pregripper of a feeder for a sheet-fed rotary printing press, comprising:

a pregripper shaft and a pregripper assembly supported on said pregripper shaft, said pregripper assembly including a gripper bar having end supports supported on said regripper shaft, and a plurality of sheet grippers disposed side by side on said gripper bar for gripping an slaving sheets in a sheet feeding direction;

a frame-fixed brace disposed on said pregripper shaft and located approximately centrally between said end supports of said gripper bar, said frame-fixed brace serving to elastically bend said gripper bar in the sheet-feeding direction before a sheet is gripped by said sheet grippers;

an adjustable cam having a frame-fixed support;

said frame-fixed brace including an eccentric element with a lever arm articulated on an eccentric joint, and a cam roller carried on said lever arm distally from said eccentric joint, said cam roller rolling on said adjustable cam.

2. The device according to claim 1, wherein said eccentric element has an axis disposed approximately centrally in an imaginary plane through an axis of said pregripper shaft and a center of the gripper bar.

3. The device according to claim 1, including a spring in biassing relationship with said lever arm, and wherein said cam and said cam roller are in cooperative engagement for rotating said eccentric element out of an adjustable stop position thereof counter to said spring.

4. The device according to claim 2, wherein said cam is mounted on a frame of the printing press so as to be swivellable about an axis oriented parallel to said axis of said eccentric element, and including an adjusting member for adjusting said cam in the swivelled position thereof.

5. The device according to claim 4, wherein said adjusting member comprises a setscrew screwable into a thread formed in a frame-fixed nut and operative at one end thereof on said cam, and a spring for holding said cam against said one end of said setscrew.

6. The device according to claim 4, including a support arm having a bearing braced on said pregripper shaft, said eccentric element being supported just below said gripper bar in said bearing of said support arm.

7. The device according to claim 2, wherein said axis of said eccentric element is offset towards said cam with respect to the imaginary plane through the axis of said pregripper shaft and said center of said gripper bar.

* * * * *